US011401084B2

(12) United States Patent
Lee et al.

(10) Patent No.: US 11,401,084 B2
(45) Date of Patent: Aug. 2, 2022

(54) PACKAGING AND DOCKING SYSTEM FOR NON-CONTACT CHEMICAL DISPENSING

(71) Applicant: Ecolab USA Inc., Saint Paul, MN (US)

(72) Inventors: Amy Louise Lee, Ridgeland, WI (US); Kenneth Thomas Dobizl, Mounds View, MN (US)

(73) Assignee: Ecolab USA Inc., Saint Paul, MN (US)

( * ) Notice: Subject to any disclaimer, the term of this patent is extended or adjusted under 35 U.S.C. 154(b) by 214 days.

(21) Appl. No.: 16/782,559

(22) Filed: Feb. 5, 2020

(65) Prior Publication Data

US 2020/0247590 A1 Aug. 6, 2020

Related U.S. Application Data

(60) Provisional application No. 62/801,632, filed on Feb. 5, 2019.

(51) Int. Cl.
*B65D 83/04* (2006.01)
*B65D 47/10* (2006.01)
(Continued)

(52) U.S. Cl.
CPC ..... *B65D 47/103* (2013.01); *B65D 47/36* (2013.01); *B65D 83/04* (2013.01); *B65D 47/123* (2013.01)

(58) Field of Classification Search
CPC ..... B65D 83/04; B65D 83/0409
(Continued)

(56) References Cited

U.S. PATENT DOCUMENTS 1,131,255 A * 3/1915 Luellen ..... G07F 11/045 221/155
1,155,562 A * 10/1915 Gilchrist ..... A47F 1/085 221/287
(Continued)

FOREIGN PATENT DOCUMENTS

BR MU8600815 Y1 7/2015
CH 679374 A5 2/1992
(Continued)

OTHER PUBLICATIONS

Dickason et al., "RingCap Technology," Drugs and the Pharmaceutical Sciences, vol. 126, Modified-Release Drug Delivery Technology, 2003, Section 5, pp. 49-57.
(Continued)

*Primary Examiner* — Paul R Durand
*Assistant Examiner* — Michael J. Melaragno
(74) *Attorney, Agent, or Firm* — Fredrikson & Byron, P.A.

(57) ABSTRACT

A chemical dispensing system can include a docking stating that receives a reservoir containing chemical to be dispensed. The reservoir may have one or more retention tabs which are movable from a first position in which each tab extends radially across at least a portion of the bore to a second position in which each tab is offset relative to the bore. A user can engage the reservoir with the docking station, causing the one or more retention tabs on the reservoir to engage with one or more corresponding retention tab receiving regions. This can cause each retention tab to move from the first position to the second position, thereby dispensing chemical from the bore through a discharge aperture of the docking station. In this way, the contents of the reservoir may be dispensed without the user
(Continued)

coming into physical content with the chemical in the reservoir.

20 Claims, 6 Drawing Sheets

(51) Int. Cl.
*B65D 47/36* (2006.01)
*B65D 47/12* (2006.01)

(58) Field of Classification Search
USPC ..... 221/303, 267
See application file for complete search history.

(56) References Cited

U.S. PATENT DOCUMENTS 1,289,487 A * 12/1918 Lockwood ..... A47F 1/085 221/287
1,648,147 A * 11/1927 Prudden ..... A47F 1/085 221/135
1,671,285 A * 5/1928 Hanna ..... B65D 83/04 206/445
2,365,916 A * 12/1944 Terry ..... A47F 1/106 221/303
2,431,121 A * 11/1947 Hunter ..... G07D 1/08 453/51
3,067,787 A * 12/1962 Salk ..... B65D 55/02 141/321
3,112,046 A * 11/1963 Szekely ..... B65D 83/0409 221/2
3,211,329 A * 10/1965 Boyd ..... A47F 1/106 221/279
3,228,556 A * 1/1966 Nonestied ..... A63F 11/0002 221/279
3,511,409 A 5/1970 Huck
3,516,536 A 6/1970 Ino
3,780,735 A * 12/1973 Crouter ..... A61D 7/00 604/59
3,833,147 A 9/1974 Borsum et al.
3,998,238 A * 12/1976 Nigro ..... G07D 1/08 221/279
4,040,515 A 8/1977 Hessel et al.
4,062,385 A 12/1977 Katusha et al.
4,113,143 A * 9/1978 Spagnola, Jr. ..... A63F 11/0002 221/267
4,174,048 A * 11/1979 Volpe, Jr. ..... B65D 83/0409 206/537
4,199,001 A 4/1980 Kratz
4,216,885 A 8/1980 Sedam
4,250,911 A 2/1981 Kratz
4,595,520 A 6/1986 Heile et al.
4,614,286 A 9/1986 Yamaguchi et al.
4,676,399 A 6/1987 Burckhardt
4,680,134 A 7/1987 Heile et al.
4,691,732 A 9/1987 Johnson et al.
RE32,763 E 10/1988 Fernholtz et al.
RE32,818 E 1/1989 Fernholz et al.
4,830,509 A 5/1989 Gulmatico
4,887,738 A * 12/1989 Jennings ..... B65D 83/0409 221/264
4,984,709 A 1/1991 Weinstein
5,009,561 A 4/1991 Lombardino et al.
5,018,560 A 5/1991 Tsukamoto
5,040,024 A 8/1991 Fukuda et al.
5,089,854 A 2/1992 Kaieda et al.
5,091,750 A 2/1992 Yoshida et al.
5,199,601 A * 4/1993 Roethel ..... A47F 1/085 221/302
5,201,869 A * 4/1993 Roethel ..... A47F 1/085 221/304
5,222,628 A * 6/1993 Roethel ..... A47F 1/085 221/307
5,230,433 A 7/1993 Hamilton et al.
5,268,153 A 12/1993 Muller
5,316,688 A 5/1994 Gladfelter et al.
5,363,177 A 11/1994 Nakano et al.
5,417,939 A 5/1995 Bunschoten et al.
5,475,479 A 12/1995 Hatakeyama et al.
5,490,546 A 2/1996 Lhoest
5,560,516 A 10/1996 Hinterreiter
5,593,068 A 1/1997 Kitayama et al.
5,961,845 A 10/1999 List et al.
5,979,696 A 11/1999 Bode et al.
6,138,703 A 10/2000 Ferguson et al.
6,177,392 B1 1/2001 Lentsch et al.
6,309,538 B1 10/2001 Khan
6,325,243 B1 * 12/2001 Bennett ..... A47F 1/085 221/307
6,432,359 B1 8/2002 Carey et al.
6,435,231 B1 8/2002 Cooper et al.
6,451,271 B1 9/2002 Hammonds
6,779,539 B1 8/2004 Schwamberger et al.
6,910,579 B2 6/2005 Reinke et al.
7,059,759 B2 6/2006 Hummer
7,207,464 B2 * 4/2007 Brenner ..... B65D 83/049 221/247
7,300,196 B2 11/2007 Fleig
7,703,621 B2 4/2010 Evans et al.
8,852,442 B2 10/2014 Hayas et al.
8,889,048 B2 11/2014 Stolte et al.
9,452,457 B2 9/2016 Denvir et al.
2002/0025193 A1 2/2002 Boogert et al.
2002/0195404 A1 12/2002 Pickens et al.
2003/0146237 A1 * 8/2003 Costa ..... A47J 31/3642 221/270
2004/0065672 A1 * 4/2004 Kaplan ..... A47F 1/106 221/303
2005/0244315 A1 11/2005 Greaves et al.
2006/0048841 A1 3/2006 Luehrsen et al.
2006/0201774 A1 * 9/2006 Seiffert ..... B65B 35/12 193/32
2007/0051739 A1 * 3/2007 Giraud ..... B29C 33/44 220/839
2007/0170203 A1 * 7/2007 Jarisch ..... A47F 1/10 221/303
2008/0296214 A1 12/2008 Blanchette
2009/0308889 A1 12/2009 Lindsay et al.
2010/0294791 A1 * 11/2010 Weibel ..... B65D 83/0409 221/1
2011/0036454 A1 2/2011 Saito et al.
2011/0168608 A1 7/2011 Gaffey
2012/0067968 A1 3/2012 Brennan et al.
2012/0138544 A1 6/2012 Barani
2013/0098820 A1 4/2013 King et al.
2013/0294978 A1 11/2013 Mariano et al.
2014/0054210 A1 2/2014 King et al.
2014/0084018 A1 3/2014 Onillon et al.
2017/0052051 A1 2/2017 Emmert
2017/0153575 A1 6/2017 Schulkes et al.
2017/0332661 A1 11/2017 McGill et al.
2019/0241422 A1 8/2019 Lee et al.
2020/0031512 A1 1/2020 McAleavy et al.

FOREIGN PATENT DOCUMENTS

CN 1134749 A 10/1996
CN 101226363 A 7/2008
CN 206842145 U 1/2018
DE 3143953 A1 5/1983
EP 176960 A2 4/1986
EP 236039 A2 9/1987
EP 0514168 A2 11/1992
EP 1118588 A2 7/2001
EP 834472 B1 12/2002
EP 1961668 A1 8/2008
EP 2131885 B1 6/2013
FR 2750780 A1 1/1998
FR 2898114 A1 9/2007
FR 2935691 A1 3/2010
GB 1228062 A 4/1971
JP H04-369668 A 12/1992

(56) References Cited

FOREIGN PATENT DOCUMENTS

| | | | |
|---|---|---|---|
| JP | 2009286435 | A | 12/2009 |
| JP | 2012171683 | A | 9/2012 |
| JP | 2012171685 | A | 9/2012 |
| JP | 2013079090 | A | 5/2013 |
| SU | 1193012 | A2 | 11/1985 |
| SU | 1219415 | A1 | 3/1986 |
| WO | 8500156 | A1 | 1/1985 |
| WO | 9117103 | A1 | 11/1991 |
| WO | 9318985 | A1 | 9/1993 |
| WO | 9728066 | A1 | 8/1997 |
| WO | 0029306 | A1 | 5/2000 |
| WO | 0063087 | A1 | 10/2000 |
| WO | 0123065 | A1 | 4/2001 |
| WO | 03013962 | A1 | 2/2003 |
| WO | 03086901 | A1 | 10/2003 |
| WO | 2005004785 | A2 | 1/2005 |
| WO | 2007039779 | A1 | 4/2007 |
| WO | 2007068059 | A1 | 6/2007 |
| WO | 2007125353 | A1 | 11/2007 |
| WO | 2008089306 | A2 | 7/2008 |
| WO | 2009080309 | A2 | 7/2009 |
| WO | 2014033080 | A1 | 3/2014 |
| WO | 2016010352 | A1 | 1/2016 |
| WO | 2017123496 | A1 | 7/2017 |

OTHER PUBLICATIONS

International Patent Application No. PCT/US2020/016781, International Search Report and Written Opinion dated Jun. 9, 2020, 14 pages.

* cited by examiner

PACKAGING AND DOCKING SYSTEM FOR NON-CONTACT CHEMICAL DISPENSING

CROSS-REFERENCE

This application claims the benefit of U.S. Provisional Patent Application No. 62/801,632, filed Feb. 5, 2019, the entire contents of which are incorporated herein by reference.

TECHNICAL FIELD

This disclosure relates to chemical product dispensing including packaging and docking systems for holding and dispensing chemical products.

BACKGROUND

Chemical product dispensers are useful in many different chemical application systems, including water treatment systems like commercial cooling water systems, cleaning systems relating to food and beverage operations, laundry operations, warewashing operations (e.g., dishwashers), pool and spa maintenance, as well as other systems, such as medical operations. For example, chemical products used in water treatment systems may include oxidizing and non-oxidizing biocides to inhibit or destroy growth or activity of living organisms in the water being treated. As another example, chemical products used in food and beverage operations may include sanitizers, sterilants, cleaners, degreasers, lubricants, etc. Chemical products used in a warewashing or laundry operation may include detergent, sanitizers, stain removers, rinse agents, etc. Chemical products used in a laundry operation may include detergent, bleaches, stain removers, fabric softeners, etc. Chemical products used in cleaning of medical/surgical instrumentation may include detergents, cleaning products, neutralizers, sanitizers, disinfectants, enzymes, etc.

For low volume and non-commercial applications, chemical products are often provided in ready-to-use form. The chemical product may be formulated at the correct concentration for the intended application and may be applied directly without diluting or otherwise modifying the chemical composition of the product. In other applications, such as high-volume use facilities and commercial applications, a desired chemical product may be formed on site from one or more concentrated chemical components. The concentrated chemical may be introduced into an automated dispenser system where the chemical is contacted with water to form a dilute, ready-to-use solution.

Providing concentrated chemical product to a user that is then diluted on site is useful to reduce packaging, shipping, and storage requirements that would otherwise be needed to provide an equivalent amount of product in ready-to-use form. However, a user receiving concentrated chemical typically needs to transfer the chemical from the container in which it is received into a dispenser system that formulates the ready-to-use solution. If performed incorrectly, the concentrated chemical may be spilled during transfer, potentially exposing the user to the chemistry or otherwise creating an environmental cleanup issue.

SUMMARY

In general, this disclosure relates to packaging for chemical products and dispenser systems for transferring a chemical product from a package to a desired dispense location.

The packaging and dispenser may work cooperatively to provide safe, non-contact transfer of chemical product out of the packing in which it is stored through the dispenser and into a dilution system or other receiving reservoir attached to the dispenser. In some examples, the dispenser is a configured as a docking station. The chemical product can be shipped to the user in a reservoir that provides a barrier between the chemical contained in the reservoir and the exterior environment. The user can engage the reservoir with the docking station and further manipulate the docking station to open the reservoir. As a result, chemical in the reservoir can discharge through the opening uncovered by manipulation of the docking station. In this way, the contents of the reservoir may be dispensed without the user coming into physical content with chemical contained in the reservoir.

While the packaging in which the chemical product is stored can have a variety of different configurations, in some examples, the packing includes a reservoir closed (at least partially) with one or more retention tabs. The retention tab may be defined by a strip of material extending at least partially across a bottom opening of the reservoir, e.g., radially. The retention tab may retain chemical in the reservoir by providing an obstruction against which the chemical cannot bypass until the retention tab is moved out of the way. In some configurations, the retention tab may articulate between a first or closed position and a second or open position. For example, the retention tab may be hingedly mounted and configured to rotate between the first position and the second position.

The reservoir containing the retention tab may be docked in a docking station that has one or more retention tab receiving regions. Upon inserting the reservoir in the docking station, the retention tab on the reservoir may engage the corresponding retention tab receiving region of the docking station. For example, the retention tab receiving region may be an annular space bounded by inner and outer walls. As the reservoir containing the retention tab is inserted into the docking station, a top surface of the inner wall may bias the retention tab axially, moving the retention tab from the first position to the second position. In the second position, the retention tab may extend substantially axially (e.g., parallel to a longitudinal axis of the reservoir) and may be inserted into the retention tab receiving region. When so positioned, the bottom surface of the reservoir may be unobstructed, allowing the chemical contained in the reservoir to flow out of the reservoir and through the docking station.

During use, an unopened reservoir containing chemical to be dispensed may be inserted into the docking station and opened by moving the reservoir axially into the docking station. In some implementations, the reservoir and docketing station have complementary engagement features (e.g., threading, bayonet connectors) that engage with each other as the reservoir is inserted into the docketing station. For example, the reservoir may have threading that engages with complementary threading on the docking station. The reservoir may be inserted axially into the docking station by rotating the reservoir and docking station relative to each other. The retention tab on the reservoir may move from a generally radially position to a generally axial position as the reservoir is inserted into the docking station, thereby moving the retention tab out of the flow path of the chemical contained in the reservoir. This can allow some or all of the contents of the reservoir to dispense into an intended discharge reservoir, such as a product dispenser that receives concentrated chemical and prepares a target solution from the concentrated chemical. In this manner, the chemical product to be dispensed may be stored, shipped, and transferred out of the reservoir in which it is held without the user needing to directly contact or interact with the chemical contained in the reservoir.

In one example, a chemical dispensing system is described that includes a reservoir, at least one retention tab, and a docking station. The reservoir defines a bore configured to contain a chemical. The reservoir also has a bottom end through which the chemical is intended to be dispensed. The example specifies that the system includes at least one retention tab adjacent the bottom end of the reservoir. The retention tab is movable from a first position in which the tab extends radially across at least a portion of the bore to a second position in which the tab is offset relative to the bore. The docking station has a discharge aperture and at least one retention tab receiving region. The example specifies that the docking station is configured to receive the reservoir with the retention tab engaging the retention tab receiving region, thereby causing the retention tab to move from the first position to the second position and dispense the chemical from the bore through the discharge aperture of the docking station.

In another example, a chemical dispensing reservoir is described. The reservoir includes a reservoir defining a bore configured to contain a chemical. The reservoir has a bottom end through which the chemical is configured to be dispensed. The reservoir also includes at least one retention tab adjacent the bottom end of the reservoir. The example specifies that the retention tab is movable from a first position in which the tab extends radially across at least a portion of the bore to a second position in which the tab is offset relative to the bore.

In another example, a method is described that includes inserting a reservoir having a bore containing chemical that is held in the bore by at least one retention tab extending radially across at least a portion of the bore into a docking station. The docking station has at least one retention tab receiving region. The example method also involves engaging the retention tab with the retention tab receiving region, thereby causing the retention tab to move to a position that is offset relative to the bore, causing chemical to dispense from the bore through a discharge aperture of the docking station.

The details of one or more examples are set forth in the accompanying drawings and the description below. Other features, objects, and advantages will be apparent from the description and drawings, and from the claims.

DETAILED DESCRIPTION

This disclosure generally relates to chemical packaging and dispenser systems. In some examples, a chemical is packaged in a reservoir that surrounds and holds the chemical for later discharge. The reservoir may have a closed top end, a bottom end that defines an opening, and one or more sidewalls surrounding the sides of the reservoir. The bottom end of the reservoir may include a retention tab that is movable to selectively open and close the discharge opening of the reservoir. The retention tab closing the bottom end of the reservoir may engage with a corresponding retention tab receiving region on a docking station. As the reservoir is inserted into the docking station, the retention tab may move to fit within the constrained space of the retention tab receiving region, thereby causing the retention tab to move from an obstructing position to an unobstructing position for the chemical contained in the reservoir. Since the reservoir can be inserted into the docking station without first being opened in such a configuration, the likelihood of the user coming into contact with the contents of the reservoir is reduced as compared to if the user is required to manually open and dump the contents of the reservoir.

Figure 1:
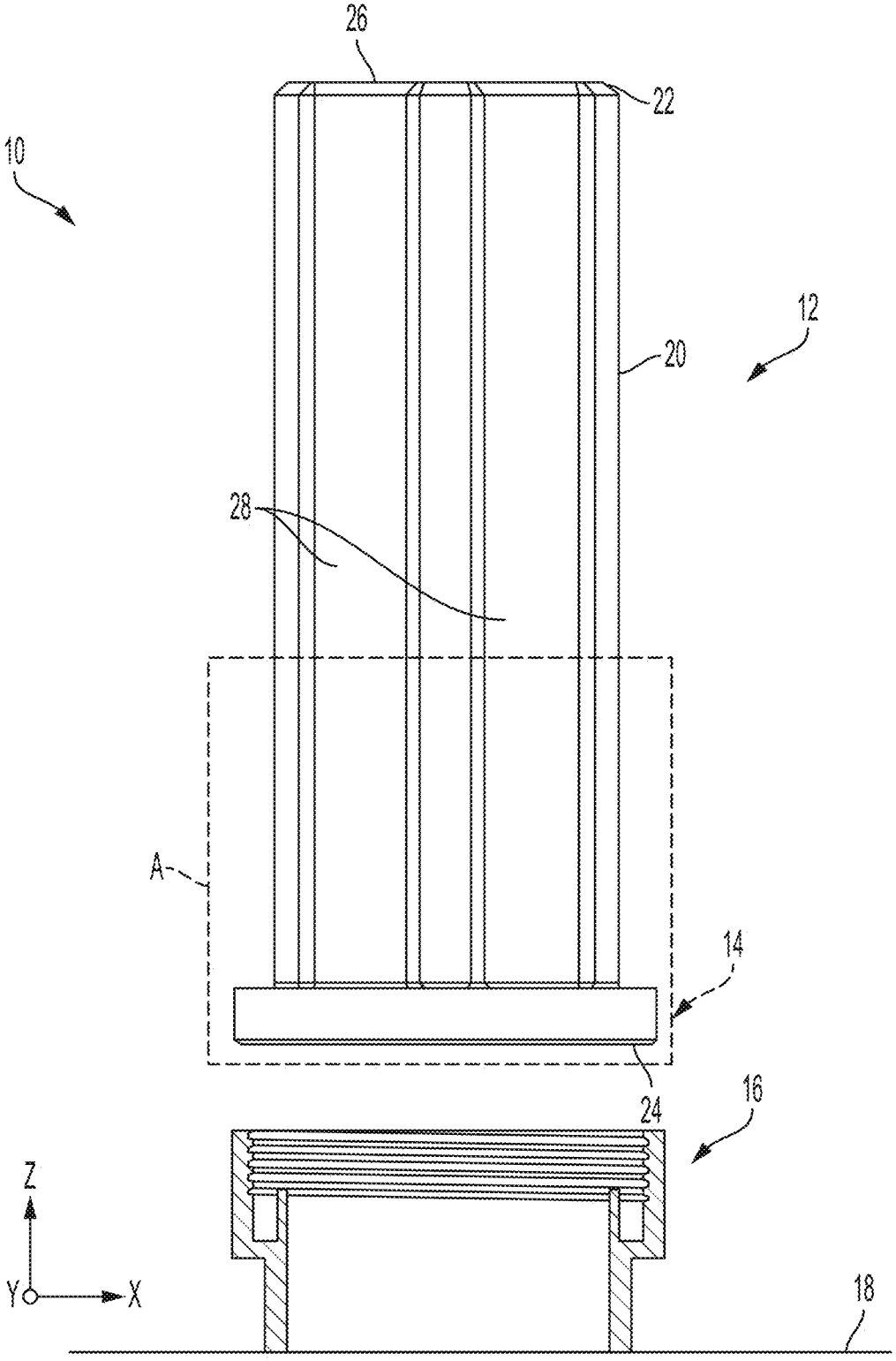
FIG. 1 is a side view of an example chemical dispensing system.

FIG. 1 is a side view of an example chemical dispensing system 10 that includes a reservoir 12, a cap 14, and a docking station 16. Reservoir 12 can be configured to hold any desired chemical to be dispensed, examples of which are discussed in greater detail below. Docking station 16 can receive reservoir 12 by removing cap 14 and inserting the reservoir axially into the docking station (in the negative Z-direction indicated on FIG. 1). In practice, docking station 16 may be permanently or removably attached to a receiving reservoir 18 that is intended to receive the discharged contents of reservoir 12.

As discussed in greater detail below, reservoir 12 may define a bore, or hollow inner lumen, containing chemical to be dispensed. The chemical may be contained within the bore until the reservoir is at least partially, and in some implementations fully, inserted into docking station 16. Reservoir 12 may be inserted into docking station 16 by moving the reservoir axially with respect to the docking station, for example, axially downwardly with respect to gravity. Reservoir 12 may be closed by one or more retention tabs when inserted into docking station 16 such that an operator does not need to pre-open the reservoir prior to inserting the reservoir into the docking station. When configured with optional cap 14 as shown in FIG. 1, however, the operator may remove the cap while the contents of the reservoir remain held in the bore of the reservoir by one or more retention tabs. In either case, the process of inserting reservoir 12 into docking station 16 may cause a movable retention tab to move from a first position in which the tab bounds the contents of the reservoir to a second position in which the tab offset from the discharge opening of the reservoir. Since the retention tab may not move to the offset position until reservoir 12 is at least partially inserted into docking station 16, the operator may dispense the contents of reservoir 12 while minimizing the likelihood of inadvertent contact with chemical contained in the reservoir during the transfer process.

In general, reservoir 12 may be any structure configured to contain a chemical to be dispensed. Reservoir 12 may define a bounded cavity that partially or fully separates the contents therein from the external environment. Reservoir 12 may be formed by at least one sidewall 20 that extends from a terminal top end 22 to a terminal bottom end 24. In some examples, such as the example illustrated in FIG. 1, the top end 22 of reservoir 12 may be completely closed by a top wall 26. In other examples, the top end 22 of reservoir 12 may be partially or fully open, e.g., defining an opening sized less than the contents in reservoir 12 such that the contents cannot come out through the top opening. In either case, the bottom end 24 of reservoir 12 may be open (e.g., such that the contents of the reservoir can discharge to the external environment through the opening) but selectively closable with one or more retention tabs as described in greater detail below (e.g., FIGS. 2 and 3).

It should be appreciated that the descriptive terms "top" and "bottom" with respect to the configuration and orientation of components described herein are used for purposes of illustration based on the orientation in the figures. The arrangement of components in real world application may vary depending on their orientation with respect to gravity. Accordingly, unless otherwise specified, the general terms "first" and "second" may be used interchangeably with the terms "top" and "bottom" with departing from the scope of disclosure.

In the example of FIG. 1, reservoir 12 includes at least one sidewall 20. Sidewall 20 extends upwardly (in the Z-direction indicated on FIG. 1) from bottom end 24. The number of sidewalls interconnected together to form the side structure of reservoir 12 extending between the top and 22 and bottom end 24 may vary depending on the shape of the reservoir. For example, a reservoir with a circular cross-sectional shape (e.g., in the X-Y plane) may be formed of a single sidewall whereas a reservoir with a square or rectangular cross-sectional shape may be defined by four interconnected sidewalls.

In general, reservoir 12 can define any polygonal (e.g., square, hexagonal) or arcuate (e.g., circular, elliptical) shape, or even combinations of polygonal and arcuate shapes. In some examples, such as the example shown in FIG. 1, reservoir 12 includes one or more recesses or dimples 28 projecting radially inwardly and extending at least partially along the axial length of the reservoir. Such recess(es) may help prevent chemical contained in the reservoir from moving during shipping, reducing the likelihood of product breakage or dusting. Reservoir 12 can be fabricated from a material that is chemically compatible with and chemically resistant to the type of chemical placed in the reservoir. In some examples, reservoir 12 is fabricated from a polymeric material, such as a molded plastic.

Reservoir 12 can define any suitable size, and the specific dimensions of the reservoir may vary depending on the volume of chemical intended to be held by the reservoir. In some configurations, reservoir 12 defines a height (in the Z-direction indicated on FIG. 1) greater than a width and/or length (in the X-Y plane). When so configured, reservoir 12 may be elongated in the vertical direction relative to the horizontal plane. This configuration may be useful for orienting chemical contained in the reservoir in a vertically stacked alignment, which may help the chemical subsequently dispense under the force of gravity out of the reservoir upon being opened. In other configurations, however reservoir 12 may have a width and/or length (in the X-Y plane) that is equal to or greater than the height (in the Z-direction indicated on FIG. 1).

While the size of reservoir 12 may vary, in some examples, the reservoir is designed to hold from 0.5 to 5 liters of chemical. For example, reservoir 12 may have a height in the Z-direction indicated in FIG. 1 ranging from 5 to 50 centimeters. Reservoir 12 may further define a cross-sectional area in the X-Y plane indicated on FIG. 1 ranging from 10 to 120 square centimeters. It should be appreciated that the foregoing dimensions are merely examples, and a reservoir in accordance with the disclosure is not limited in this respect.

Figure 2:
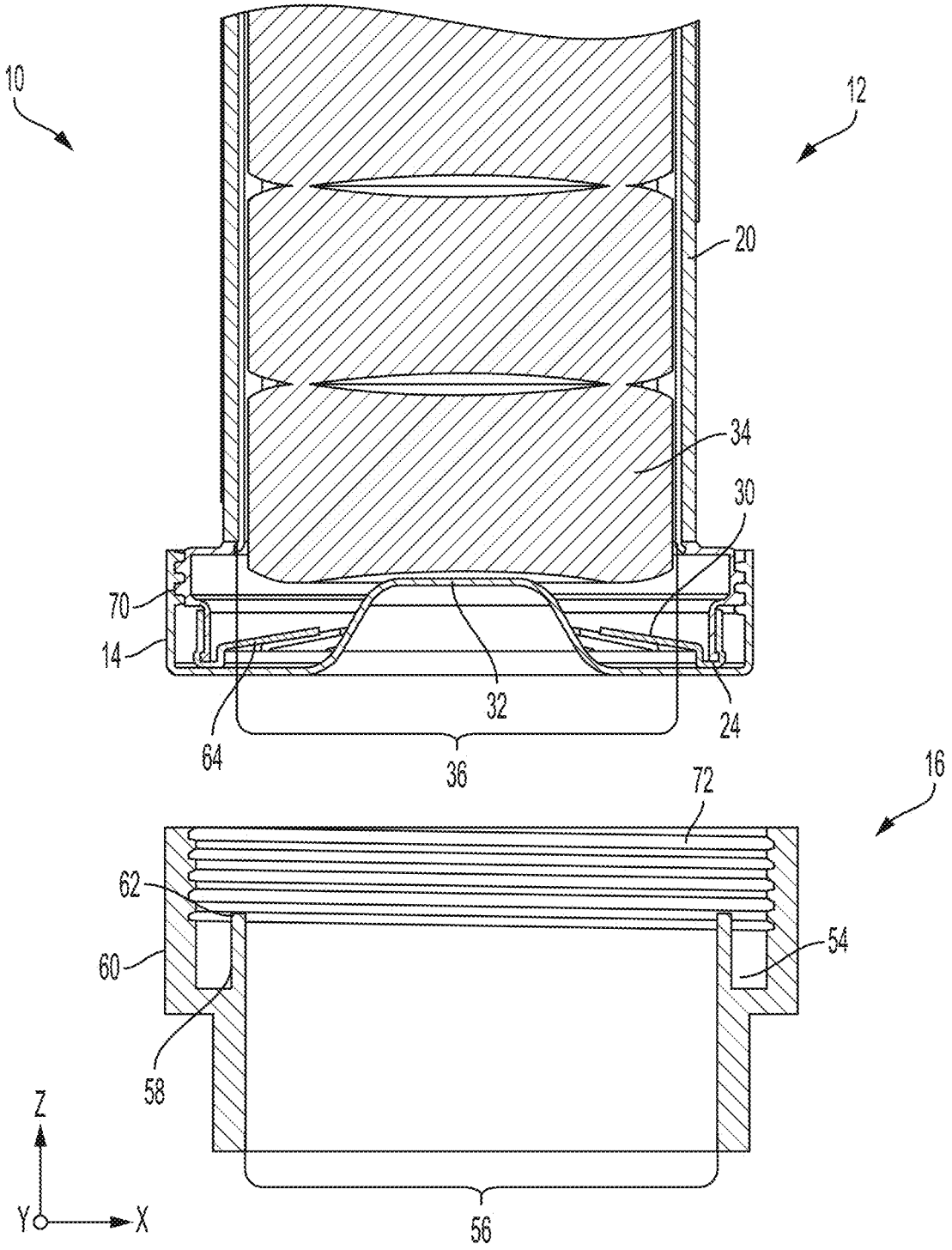
FIG. 2 is an exploded sectional view of the A-section indicated on FIG. 1 taken along the X-Z plane indicated on FIG. 1.

Reservoir 12 may include one or more retention tabs that retain chemical within a bore defined by sidewall 20 of the reservoir until the reservoir is inserted into docking station 16. FIG. 2 is an exploded sectional view of the A-section indicated on FIG. 1 taken along the X-Z plane indicated on FIG. 1. FIG. 2 illustrates an example configuration of reservoir 12 that includes at least one retention tab 30 configured to retain chemical in the reservoir until the reservoir is inserted into docking station 16. In the illustrated configuration, cap 14 is shown positioned over the bottom end of reservoir 12, e.g., to close the bottom end for transport and storage. In other configurations, cap 14 may not be utilized on reservoir 12 and/or a cap may be utilized having a different configuration.

In the illustrated configuration, cap 14 includes an upwardly extending support surface 32 (e.g., extending above tab 30) against which chemical 34 to be dispensed may press when the cap is installed over the bottom end of reservoir 12. Such a cap configuration may be useful to provide a more rigid mechanical support, e.g., for transport and storage of chemical 34, than having the chemical press against retention tab 30 for an extended period of time. When so configured, cap 14 may be removed prior to dispensing chemical 34. As cap 14 is removed from reservoir 12, chemical 34 may fall downwardly until the chemical is resting on a top surface of retention tab 30. Retention tab 30 may retain chemical 34 in reservoir 12 until the reservoir is inserted into docking station 16, as will be described in more detail below. In other configurations, chemical 34 may contact retention tab 30 during storage and transport instead of being supported by support surface 32 of cap 14. Accordingly, the disclosure is not limited to the example arrangement of cap 14 and tab 30 illustrated in FIG. 2.

In general, each retention tab 30 may be portion of material extending at least partially, and in some configurations fully, across a cross-section of the bottom end of reservoir 12 defining an outlet opening 36 (shown closed by cap 14 in FIG. 2). Retention tab 30 may retain chemical 34 in reservoir 12 by providing a support surface against which the chemical can rest (e.g., until the retention tab is moved to an offset position to dispense the chemical). Retention tab 30 can move from a position in which the tab extends at least partially across the cross-section of opening 36 to an offset position in which the tab is out of the flow path of chemical 34, allowing the chemical to dispense from reservoir 12.

In some configurations, reservoir 12 may be closed by a single retention tab 30. In other configurations, reservoir 12 may be selectively closed by a plurality of retention tabs 30, such as two, three, four, six, eight, or more retention tabs. When configured with multiple retention tabs 30, each retention tab may have the same size and shape, or at least one retention tab may have a different size and/or shape than at least one other retention tab.

Figure 3:
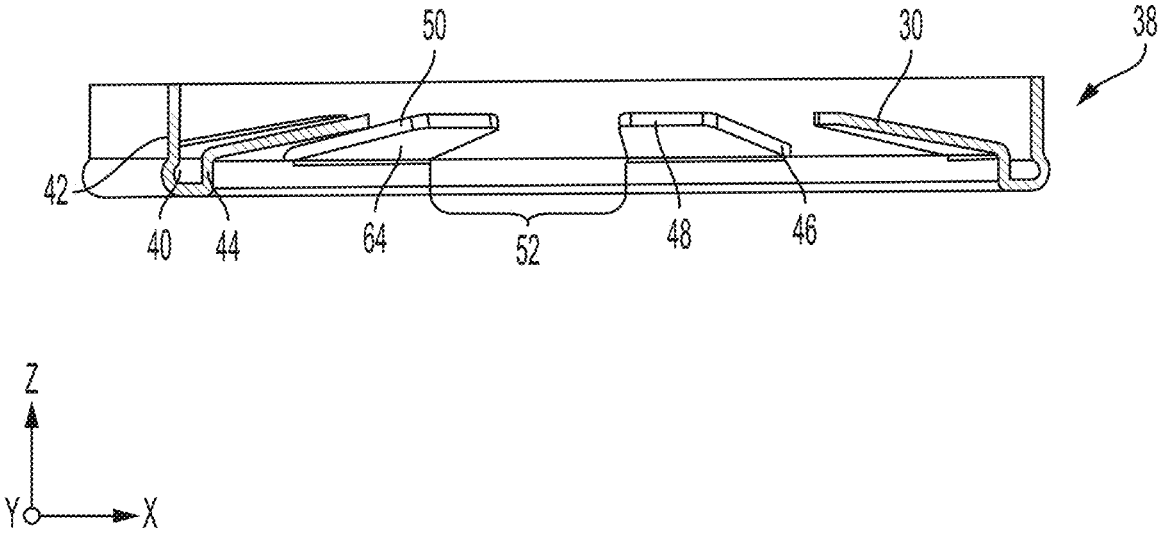
FIG. 3 is a side sectional view showing an example retention tab assembly having a plurality of retention tabs.

FIG. 3 is a side sectional view showing an example retention tab assembly 38 having a plurality of retention tabs 30. Retention tab assembly 38 in the illustrated example defines an annular groove 40 between an outer sidewall 42 and an inner sidewall 44. Bottom end 24 of sidewall 20 of reservoir 12 may be inserted into annular groove 40, with outer sidewall 42 extending along an outer surface of the sidewall 20 and inner sidewall 44 extending along an inner surface of the sidewall 20. In this way, retention tab assembly 38 may be installed on the bottom end of reservoir 12. In some implementations, retention tab assembly 38 is friction fit to the bottom end of reservoir 12, although one or more fixation elements (e.g., adhesive, ultrasonic welding, screw) may be used to help secure the retention tab assembly to the reservoir. In other configurations where reservoir 12 includes a single retention tab 30 or a plurality of retention tabs, each retention tab may not be part of a unitary assembly but may be individually secured to the bottom side of reservoir 12.

Each retention tab 30 may extend from a first end 46 adjacent sidewall 20 of reservoir 12 to a second end 48, which may be positioned closer to a geometric center of the reservoir (e.g., the bore defined by sidewall 20) than the first end. Each retention tab 30 can define any polygonal (e.g., square, hexagonal) or arcuate (e.g., circular, elliptical) shape, or even combinations of polygonal and arcuate shapes. In the example of FIG. 3, each retention tab 30 is illustrated as a strip of material that narrows in cross-sectional area from first end 46 to second end 48. For example, each retention tab 30 may define a trapezoidal shape with first end 46 providing the long edge of the trapezoid and second end 48 providing the short end of the trapezoid.

The number, size, and arrangement of retention tabs 30 may vary based on the size and shape of reservoir 12 and/or the weight and configuration of chemical 34 in the reservoir. In FIGS. 2 and 3, retention tabs 30 are illustrated as extending in a radial direction at least partially across a cross-section of bottom opening 36 of reservoir 12. In various examples, each retention tab 30 may extend a distance ranging from 10% to 90% of the cross-sectional opening size (e.g., diameter) of reservoir 12, such as from 15% to 50%, or from 20% to 40%. When reservoir 12 is closed by cap 14 (FIG. 2) that includes an upwardly extending support surface 32, each retention tab may extend across the bottom opening 36 (and, correspondingly, bore of the reservoir) a distance less than the distance where upwardly extending support surface 32 extends. For example, retention tabs 30 may be sufficiently short to define an opening between the ends of opposed retention tabs sized to receive upwardly extending support surface 32, as illustrated in FIG. 2.

As illustrated, each retention tab 30 extends radially (in the X-Y plane illustrated) across the bottom opening 36. For example, each retention tab 30 may extend parallel to sidewall 20 when closed (optionally with some upward or downward angulation). For instance, each retention tab 30 may also be directed upwardly (in the positive Z-direction) or downwardly (in the negative Z-direction) while extending radially across the bottom opening. For example, FIGS. 2 and 3 illustrate retention tabs 30 extending radially across the cross-section of bottom opening 36 and being biased upwardly. Such a configuration may help retention tabs 30 support the weight of chemical 34 (e.g., when cap 14 is removed and the chemical presses against a top surface 50 of each retention tab).

In FIG. 3, each retention tab 30 is spaced from each other retention tab a separation distance 52 (defined between the edges of adjacent first ends 46). In some examples where reservoir 12 includes a plurality of retention tabs 30, the retention tabs are arrayed substantially uniformly about a perimeter of the reservoir (e.g., such that the separation distance 52 between each retention tab is substantially the same). This may be useful to provide uniform support about the perimeter of reservoir 12 and chemical 34 contained therein. In other implementations, however, tabs 30 may be asymmetrically arranged about a perimeter of reservoir 12 defined by bottom end 24 (e.g., to one or more concentrated groupings of retention tabs).

With further reference to FIG. 2, chemical dispensing system 10 also includes docking station 16. Docking station 16 can receive reservoir 12 by inserting the reservoir axially (in the negative Z-direction indicated on FIG. 2) into the docking station. As reservoir 12 is inserted into docking station 16 retention tab 30 can move from a closed position to an open position. For example, docking station 16 may include at least one retention tab receiving region 54 corresponding to each of the one or more retention tabs 30 carried by reservoir 12. Retention tab receiving region 54 of docking station 16 may be a space that receives retention tab 30, when reservoir 12 is inserted into docking station 16.

The number, size, and arrangement of retention tab receiving regions 54 may vary based on the number, size, and arrangement of retention tabs 30 carried by reservoir 12. In FIG. 2, docking station 16 defines a discharge aperture 56, which is an opening through which chemical dispensed from reservoir 12 can pass. Retention tab receiving regions 54 are offset outwardly from discharge aperture 56 in the illustrated example. For example, each retention tab receiving region 54 may be an annular cavity bounded by an inner sidewall 58 and an outer sidewall 60. The annular cavity may be continuous about the perimeter of docking station 16 (e.g., discharge aperture 56) or one or more discontinuous annular cavities may be defined by the docking station. In either case, a top surface 62 of inner sidewall 58 may press against the bottom surface 64 of retention tab 30, e.g., as reservoir 12 is inserted into docking station 16. When so configured, retention tab 30 may move from its first position in which the tab extends across the bottom opening 36 of reservoir 12 to a second position in which the retention tab is offset relative to the bottom opening.

Retention tab receiving regions 54 may have a radial width (in the X-Y plane) less than the length of each retention tab 30. Accordingly, as reservoir 12 is inserted into docking station 16, each retention tab 30 may need to move or compress to fit within the constrained space of a corresponding retention tab receiving region 54.

For example, each retention tab 30 may be hingedly mounted (e.g., about a hinge defined by inner sidewall 44) and configured to rotate from an open position to an offset closed position. In FIG. 2, each retention tab 30 can rotate upwardly (in the positive Z-direction), moving from a position perpendicular to sidewall 20 of reservoir 12 to a position parallel to sidewall 20 of the reservoir. As reservoir 12 is inserted into docking station 16, bottom surface 64 of retention tab 30 may press against top surface 62 of inner wall 58. This may cause retention tab 30 to fold (e.g., rotate) away from bottom opening 36 to allow the retention tab to fit within retention tab receiving region 54. With each retention tab 30 rotated away from bottom opening 36, chemical 34 can dispense through bottom opening 36 of reservoir 12 and through discharge aperture 56 of docking station 16. Retention tab 30 and/or retention tab assembly 38 may be formed of material configured to flex, such as a polymeric material and/or metal.

Each retention tab 30 may be arranged to move in any suitable direction in order to move to an offset position on reservoir 12, when the reservoir is inserted into the docking station. In the example of FIG. 2, retention tab 30 is configured to move through an arc from a position perpendicular to sidewall 20 to a position parallel to sidewall 20. In other configurations, retention tab 30 may move at in other directions and/or at other angles relative to the longitudinal axis of reservoir 12. For example, retention tab 30 may be arranged in to slide (e.g., in the X-Y plane) as reservoir 12 is inserted into docking station 16 to move to an offset position.

When in a first or closed position, retention tab 30 can block or prevent chemical from discharging through opening 36 at the bottom end of the reservoir, e.g., by providing a physical barrier that chemical product cannot bypass when closed. In a second or offset position, retention tab 30 can be moved to the side of opening 36 such that chemical product is allowed to discharge past the retention tab through opening 36.

In operation, a user can insert reservoir 12 into docking station 16 and, in some examples, interlock the reservoir to the docking station. To facilitate interconnection between reservoir 12 and docking station 16, the reservoir and docking station may have corresponding mating features that overlap, interlock, and/or otherwise engage with each other when reservoir 12 is properly inserted into docking station 16. When reservoir 12 is properly inserted into docking station 16, a mechanical linkage or interconnection may be formed between the reservoir and docking station.

In general, reservoir 12 and docking station 16 can have any complementary sized and/or shaped connection features (e.g., size and/or shape indexed features). For example, reservoir 12 may have one or more projections and/or protrusions adjacent bottom end 24 to engage with one or more corresponding protrusions and/or projections inside and/or outside of docking station 16. For example, reservoir 12 and docking station 16 may have complementary bayonet connection features that interlock when the reservoir is inserted in the docking station. As another example, reservoir 12 and docking station 16 may have corresponding threading that allows the two features to threadingly engage with each other via rotation.

In FIG. 2, reservoir 12 is illustrated as having external threading 70 adjacent bottom end 24 while docking station 16 is illustrated as having complementary internal threading 72 for screwably receiving the reservoir. In this configuration, retention tab receiving region 54 is illustrated as being positioned below threading 72. In other configurations, reservoir 12 may have internal threading while docking station 16 has an external threading, retention tab receiving regions 54 may be implemented above the threading region, or yet other configurations may be utilized without departing from the scope of disclosure.

In practice, a chemical provider may supply different chemicals in similar reservoirs that are intended to be deployed for different applications. To help ensure that the end user does not inadvertently dispense the wrong chemical using chemical dispensing system 10, a system of different mating features between reservoir 12 and docking station 16 may be provided. For example, reservoir 12 may have a first type (e.g., size and/or shape) of mating feature(s) if reservoir 12 holds one type of chemical product and a second type (e.g., size and/or shape) of mating feature(s) different than the first type if reservoir 12 holds a different type of chemical product. Docking station 16 may have complementary mating feature(s) to the first type of mating feature(s) on reservoir 12 if the docking station 16 is associated with a discharge location intended to receive the first type of chemical product. Similarly, docking station 16 may have complementary mating feature(s) to the second type of mating feature(s) on reservoir 12 if the docking station 16 is associated with a discharge location intended to receive the second type of chemical product. While the foregoing example described a system with two types of different chemical products, it should be appreciated that the system may be expanded with additional sets of complementary mating features to accommodate additional chemical products. Each type of complementary mating features may be incompatible with each other type of mating features, e.g., such that a user cannot successfully insert an incorrect reservoir into a docking station intended to receive a reservoir containing a different type of chemical product. As one example of such a system configuration, the size (e.g., diameter) of the complementary mating features on reservoir 12 and docking station 16 may vary based on the type of chemical product to be dispensed.

As mentioned above, docking station 16 is illustrated as defining a discharge aperture 56. Discharge aperture 56 may be an opening through which chemical dispensed from reservoir 12 can pass. In some examples, discharge aperture 56 is sized as large are larger than opening 36 extending through the bottom surface of reservoir 12. In either case, discharge aperture 56 may be positioned such that, when reservoir 12 is properly inserted into docking station 16, opening 36 is aligned with the discharge aperture. The opening 36 may be aligned with discharge aperture 56 so that chemical product discharging from reservoir 12 through the opening 36 can pass through the discharge aperture and into the receiving space to which the docking station is connected. In some examples, opening 36 may be aligned with discharge aperture 56 such that a geometric center of the opening and discharge aperture are substantially co-linear (e.g., on a vertical axis passing through the geometric centers).

In some examples, reservoir 12 and docking station 16 are designed and arranged so that chemical product in the reservoir discharges under the force of gravity when the reservoir is opened using the docking station. For example, reservoir 12 may be oriented so a gravitational force vector causes chemical product in reservoir 12 to flow toward opening 36 without requiring additional biasing force to empty the reservoir. In other examples, a biasing force (e.g., spring force, compressed gas, external driver) may be applied to the contents in reservoir 12 to help facilitate efficient discharge of the contents upon opening the reservoir using docking station 16.

Chemical reservoir 12 may contain any type of material desired to be stored and dispensed using the reservoir. Example chemicals that may be stored and dispensed using reservoir 12 include, but are not limited to, an oxidizing biocide, a non-oxidizing biocide, a sanitizers, a sterilant, a cleaner, a degreaser, a lubricant, a detergent, a stain remover, a rinse agent, an enzyme, and the like. The chemical may be in a solid form, a liquid form, or a pseudo-solid/liquid form, such as a gel or paste.

In applications where the chemical is in a solid form, the solid chemical may be formed by casting, extruding, molding, and/or pressing. The solid chemical filling reservoir 12 may be structured as one or more blocks of solid chemical, a powder, a flake, a granular solid, or other suitable form of solid. For example, the solid chemical may be formed into a puck having a shape matching the cross-sectional shape of reservoir 12 (in the X-Y plane). The reservoir may be filled with a plurality of pucks stacked vertically one on top of another. Examples of solid product suitable for use in reservoir 12 are described, for example, in U.S. Pat. Nos. 4,595,520, 4,680,134, U.S. Reissue Pat. Nos. 32,763 and 32,818, U.S. Pat. Nos. 5,316,688, 6,177,392, and 8,889,048.

In applications where the chemical is in a liquid or pseudo-liquid form (e.g., a gel), reservoir may or may not include a film further covering opening 36. The film may be a polymeric film, a metal or metallized film, or other film structure. The film may be positioned over bottom opening 36 (e.g., over or under retention tabs 30), such that the contents of reservoir 12 are bound by the film positioned in front of the opening. The film may be retracted or otherwise removed from opening 36, e.g., either manually by a user or through a ripping or shearing force applied to the film as reservoir 12 is inserted into docking station 16. For example, retention tabs 30 may include a sharp edge or puncturing surface and the film may be positioned between chemical 34 and top surface 50 of the retention tabs. As retention tabs 30 are moved from a closed position to an open position, the retention tabs may rip through the film to expose chemical 34 for discharge.

As noted above, docking station 16 may be attached to a receiving reservoir 18 (FIG. 1) that is intended to receive the discharged contents of reservoir 12. Docking station 16 may include mechanical fixation features, such as an adhesive strip, screw or bolt holes for receiving screws or bolts, clips or snaps, or other fixation features to attach the docking station 16 to the surface of the receiving reservoir. Receiving reservoir 18 may be any structure that is intended to receive the contents of reservoir 12. Example structures may include a laundry machine, a ware wash machine, a chemical product dispenser, a medical sanitization machine, pool and/or spa equipment, or any other type of receiving reservoir. In the case of a chemical product dispenser, which may or may not be integrated into one of the foregoing example pieces of equipment described, the chemical received by the dispenser from reservoir 12 may be combined with a solvent to reduce the concentration of the chemical. For example, the chemical product dispenser may introduce an aqueous or organic solvent that contacts the chemical received from reservoir 12 to form a dischargeable liquid solution. Where the chemical received from reservoir 12 is a solid, the surface of the solid product may erode by degrading and/or shearing off from the remainder of the solid in response to being wetted with fluid. In different examples, the solid chemical may or may not react with fluid introduced by the chemical dispenser to form a resulting chemical solution dispensed from the dispenser.

Chemical dispensing system 10 may include a variety of additional or different features to help ensure that a user does not inadvertently attach a reservoir containing the wrong chemical to a docking station. For example, reservoir 12 may include a machine-readable tag and docking station 16 may include an electronic reader configured to read the machine-readable tag on reservoir 12. Docking station 16 also includes a lock that can prevent insertion of reservoir 12 and/or actuation of retention tabs 30 if information read from the machine-readable tag does not indicate that the contents of reservoir 12 are authorized to be dispensed.

A machine-readable tag usable on reservoir 12 can be any type of tag suitable for use with a noncontact reader. For example, the machine-readable tag may be a radio frequency identification tag (RFID), a near field communication tag (NFC), a barcode, or other tag containing machine readable information. The electronic reader on docking station 16 may be a noncontact reader that is configured to read the type of machine-readable information encoded on or in the tag. For example, the electronic reader may be an optical or electromagnetic reader that can scan, activate, or otherwise interact with the machine readable tag to extract information stored on or in the machine-readable tag.

Figure 4A:
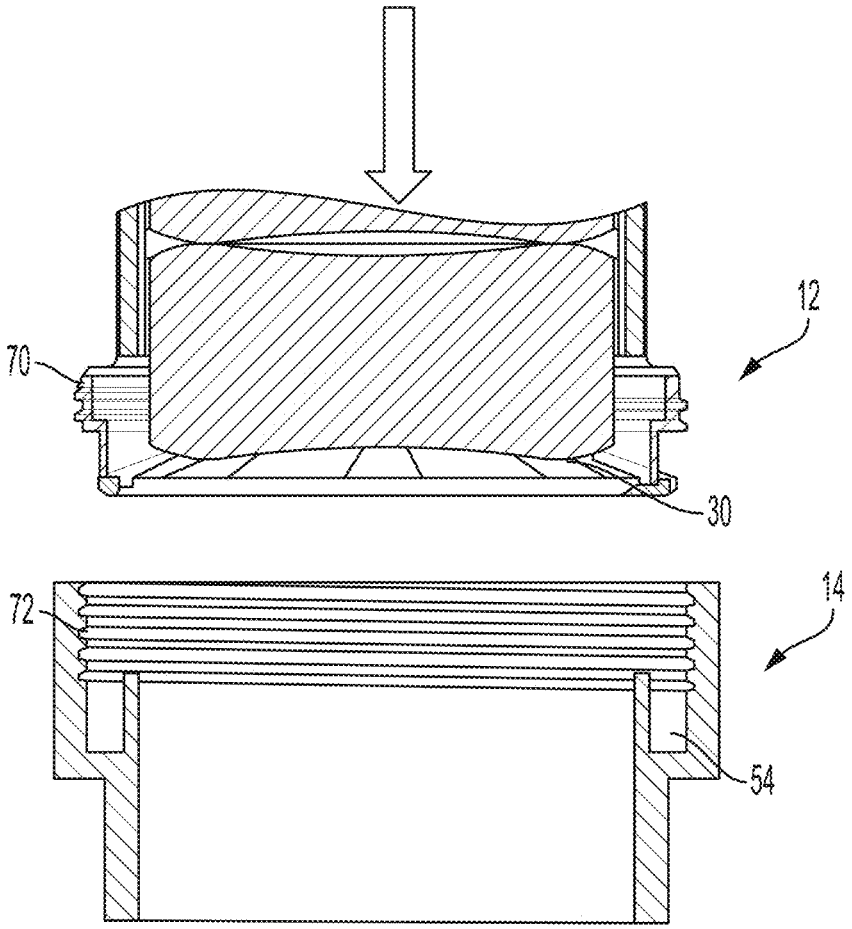
FIGS. 4A-4C illustrate an example configuration of a reservoir being docked into an example configuration of a docking station.
Figure 4B:
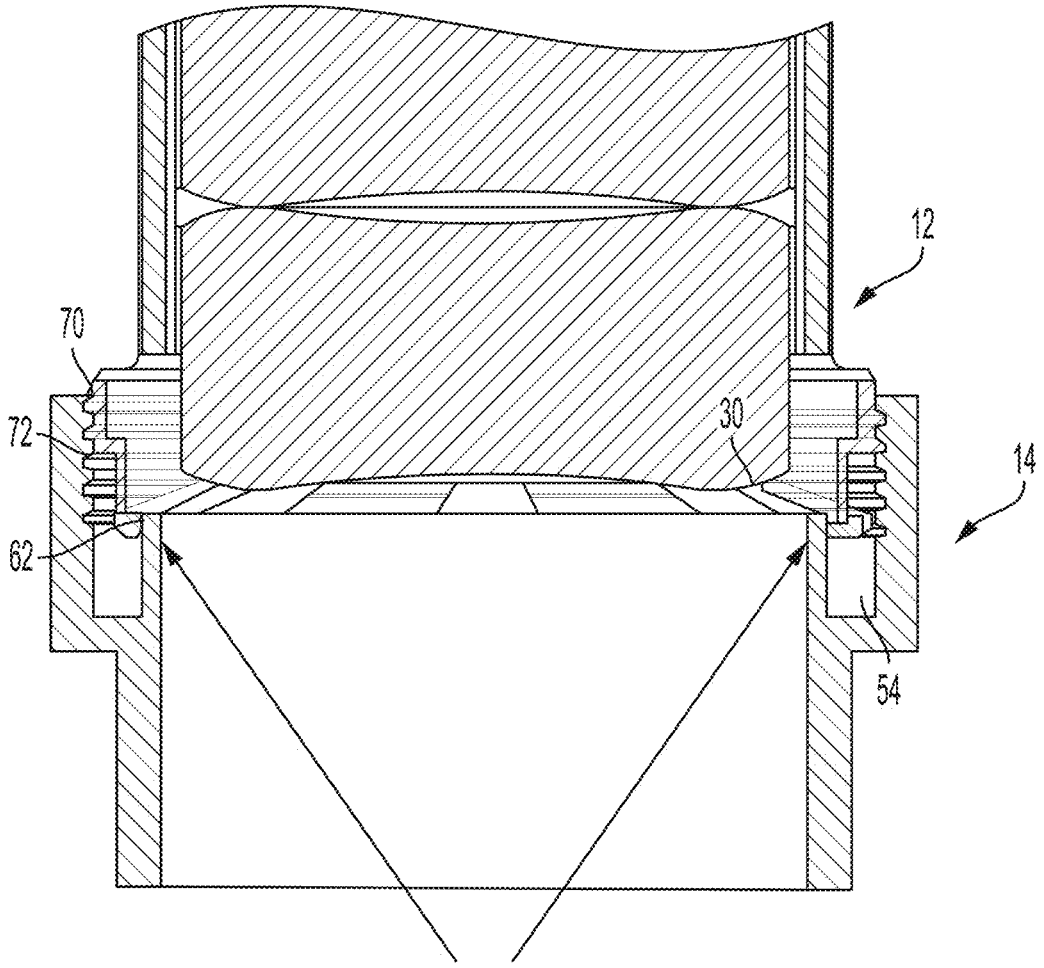
Figure 4C:
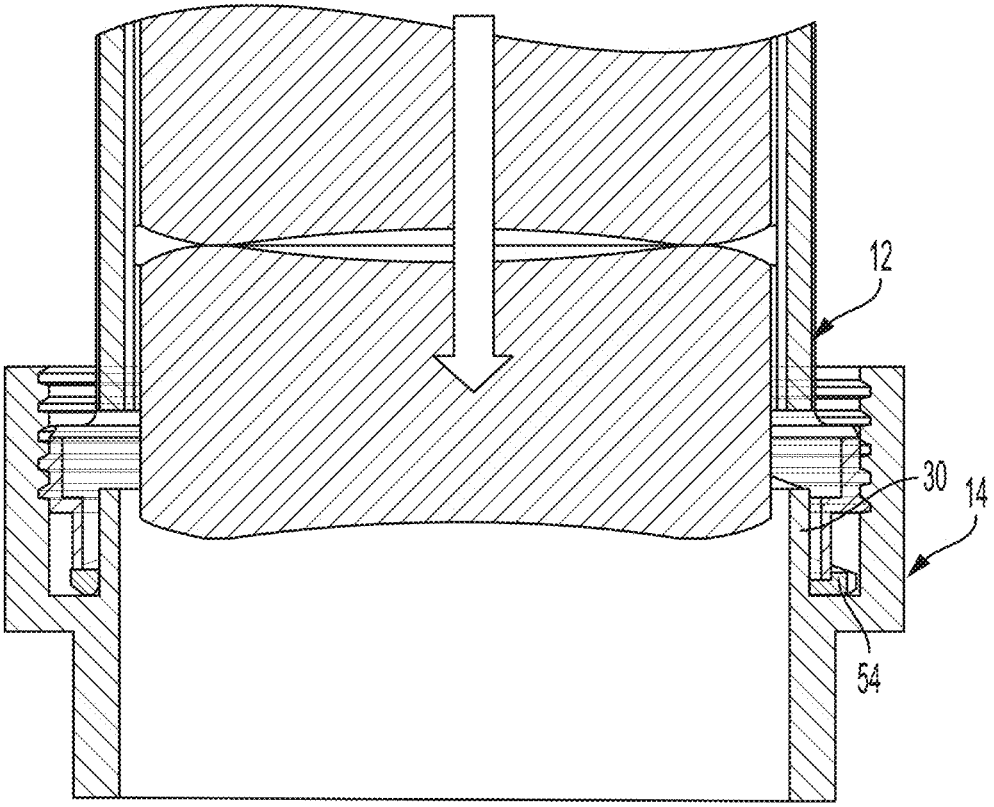

FIGS. 4A-4C illustrate an example configuration of reservoir 12 being docked into an example configuration of docking station 16. As shown in FIG. 4A, reservoir 12 is positioned with its outlet opening co-axial with the discharge aperture of docking station 16. Reservoir 12 can define a bore containing chemical that is held in the bore by at least one retention tab 30 extending radially across at least a portion of the bore. Reservoir 12 can be inserted into docking station 16 having at least one retention tab receiving region 54, e.g., by moving the reservoir axially (optionally downwardly with respect to gravity) into the docking station.

As shown in FIG. 4B, a mechanical connection 70 on reservoir 12 can be engaged with a complementary mechanical connector 72 on docking station 16. For example threading 72 on reservoir 12 can be screwed into complementary threading 72 on docking station 16. As reservoir 12 is inserted into docking station 16, the retention tab 30 on reservoir 12 can engage with the retention tab receiving region 54 on the docking station. For example, the retention tab 30 may be hingedly attached or connected to reservoir 12. As retention tab 30 contacts top surface 62 of the retention tab receiving region 54, the retention tab can rotate out of the bore of reservoir 12.

FIG. 4C illustrates that once reservoir 12 is sufficiently inserted into docking station 16, the retention tab 30 may be moved to a position that is offset relative to the bore of the reservoir, causing chemical to dispense from the bore through a discharge aperture of the docking station. For example, retention tab 30 may be flexed or bent into retention tab receiving region 54, which may be a bounded cavity defined by an inner sidewall and an outer sidewall, e.g., located below a mechanical engagement feature or region of the docking station.

A chemical dispensing system according to the disclosure may provide an efficient and safe dispensing environment for an operator to transfer chemical received from a manufacturer to an intended discharge location. The chemical may be discharged from the package in which it is received without the user physically contacting the chemical in the package. In some configurations, features such as electronically readable media on the reservoir and/or complementary connection features between the reservoir and docking station may be further provided to help prevent an operator from inadvertently attaching a package containing the wrong chemical to the wrong dispensing location.

Various examples have been described. These and other examples are within the scope of the following claims.

The invention claimed is:

1. A chemical dispensing system comprising:

a reservoir defining a bore configured to contain a chemical, the reservoir having a bottom end through which the chemical is dispensed, at least one retention tab adjacent the bottom end of the reservoir, the at least one retention tab being movable from a first position in which the tab extends radially across at least a portion of the bore to a second position in which the tab is offset relative to the bore; and a docking station having a discharge aperture and at least one retention tab receiving region, wherein the docking station is configured to receive the reservoir with the at least one retention tab engaging the at least one retention tab receiving region, thereby causing the at least one retention tab to move from the first position to the second position and dispense the chemical from the bore through the discharge aperture of the docking station, and wherein the at least one retention tab receiving region of the docking station comprises an annular cavity bounded by an inner sidewall and an outer sidewall, the inner sidewall being configured to push against the at least one retention tab as the reservoir is inserted in the docketing station and cause the tab to move from the first position to the second position.

2. The system of claim 1, wherein:

the reservoir has a top end and at least one sidewall connecting the top end to the bottom end, and the second position to which the at least one retention tab is configured to move comprises the tab extending parallel to the at least one sidewall.

3. The system of claim 1, wherein the discharge aperture is defined by the inner sidewall, and the reservoir defines a vertically elongated body having a cross-sectional size substantially equal to a cross-sectional size of the discharge aperture.

4. The system of claim 1, wherein the reservoir comprises external threading adjacent the bottom end, the docketing station comprises complementary threading for screwably receiving the external threading of the reservoir, and the annular cavity is positioned below the complementary threading.

5. The system of claim 1, wherein reservoir defines a retention tab receiving space adjacent the bottom end sized greater than or equal to a thickness of the retention tab, such that the at least one retention tab can fold into the retention tab receiving space when moved to the second position.

6. The system of claim 1, wherein the at least one retention tab is attached to the reservoir via a hinge and is configured to rotate about the hinge upwardly into the bore as it moves from the first position to the second position.

7. The system of claim 1, further comprising a retention tab assembly carrying the at least one retention tab, wherein the retention tab assembly is secured to a bottom edge of the reservoir.

8. The system of claim 1, wherein the at least one retention tab comprises a plurality of retention tabs arrayed about a perimeter of the bore.

9. The system of claim 1, wherein the reservoir further comprises a rupturable film enclosing the bottom end.

10. The system of claim 1, wherein the reservoir contains the chemical, and the chemical is one of a solid bock, solid pucks, and solid granules.

11. A chemical dispensing reservoir comprising:

a reservoir defining a bore configured to contain a chemical, the reservoir having a bottom end through which the chemical is dispensed, and at least one retention tab adjacent the bottom end of the reservoir, the at least one retention tab being movable from a first position in which the tab extends radially across at least a portion of the bore to a second position in which the tab is offset relative to the bore, wherein the at least one retention tab comprises a plurality of retention tabs arrayed about a perimeter of the bore and the reservoir further comprises external threading adjacent the bottom end.

12. The reservoir of claim 11, wherein:

the reservoir has a top end and at least one sidewall connecting the top end to the bottom end, and the second position to which the at least one retention tab is configured to move comprises the tab extending parallel to the at least one sidewall.

13. The reservoir of claim 11, wherein reservoir defines a retention tab receiving space adjacent the bottom end sized greater than or equal to a thickness of the retention tab, such that the at least one retention tab can fold into the retention tab receiving space when moved to the second position.

14. The reservoir of claim 11, wherein the at least one retention tab is attached to the reservoir via a hinge and is configured to rotate about the hinge upwardly into the bore as it moves from the first position to the second position.

15. The reservoir of claim 11, further comprising a retention ring carrying the at least one retention tab, wherein the retention ring is secured to a bottom edge of the reservoir.

16. A method of dispensing chemical comprising:

inserting a reservoir having a bore containing chemical that is held in the bore by at least one retention tab extending radially across at least a portion of the bore into a docking station, the docking station having at least one retention tab receiving region, and engaging the at least one retention tab with the at least one retention tab receiving region, thereby causing the at least one retention tab to move to a position that is offset relative to the bore, causing chemical to dispense from the bore through a discharge aperture of the docking station, wherein the at least one retention tab is attached to the reservoir via a hinge, and engaging the at least one retention tab with the at least one retention tab receiving region comprises rotating the at least one retention tab up into the bore.

17. The method of claim 16, wherein:

inserting the reservoir into the docking station comprises screwing the reservoir into the docketing station, and engaging the at least one retention tab with the at least one retention tab receiving region comprises engaging an annular cavity bounded by an inner sidewall and an outer sidewall and located below a threaded section of the docking station, causing the inner sidewall to push against the at least one retention tab as the reservoir is inserted in the docketing station.

18. A chemical dispensing reservoir comprising:

a reservoir defining a bore configured to contain a chemical, the reservoir having a bottom end through which the chemical is dispensed, and at least one retention tab adjacent the bottom end of the reservoir, the at least one retention tab being movable from a first position in which the tab extends radially across at least a portion of the bore to a second position in which the tab is offset relative to the bore, wherein reservoir defines a retention tab receiving space adjacent the bottom end sized greater than or equal to a thickness of the retention tab, such that the at least one retention tab can fold into the retention tab receiving space when moved to the second position.

19. The reservoir of claim 18, wherein:

the reservoir has a top end and at least one sidewall connecting the top end to the bottom end, and the second position to which the at least one retention tab is configured to move comprises the tab extending parallel to the at least one sidewall.

20. The reservoir of claim 18, wherein the at least one retention tab is attached to the reservoir via a hinge and is configured to rotate about the hinge upwardly into the bore as it moves from the first position to the second position.

* * * * *